United States Patent [19]

Reid

[11] Patent Number: 4,632,789

[45] Date of Patent: Dec. 30, 1986

[54] GAS HUMIDIFICATION APPARATUS

[76] Inventor: Philip L. Reid, Rte. 2, Box 422, Duncan, S.C. 29334

[21] Appl. No.: 696,733

[22] Filed: Jan. 31, 1985

[51] Int. Cl.[4] ..... B01F 3/04

[52] U.S. Cl. ..... 261/63; 261/94; 261/96; 261/123; 261/DIG. 65; 261/121.1

[58] Field of Search ..... 261/63, 121 R, 123, 261/94, 96, DIG. 65, 21, 22, 23 R; 73/202, 204, 23

[56] References Cited

U.S. PATENT DOCUMENTS

| | | | |
|---|---|---|---|
| 2,082,363 | 6/1937 | Stone | 261/123 |
| 2,453,620 | 11/1948 | Cathey et al. | 261/121 R X |
| 3,385,578 | 5/1968 | Porter | 261/DIG. 65 |
| 3,583,685 | 6/1971 | Boerger et al. | 261/121 R X |
| 3,590,902 | 7/1971 | Walker et al. | 261/121 R X |
| 3,756,577 | 9/1973 | Breiling | 261/DIG. 65 |
| 4,276,243 | 6/1981 | Partus | 73/204 X |
| 4,393,013 | 7/1983 | McMenamin | 261/DIG. 65 |

OTHER PUBLICATIONS

Dorschner, R.; "Controlled Variable Gas Humidification for Oxygen Permeability Testing"; American Can Co.; Mar. 25, 1982.

*Primary Examiner*—Richard L. Chiesa
*Attorney, Agent, or Firm*—Bailey & Hardaway

[57] ABSTRACT

This invention relates generally to the art of gas humidification and more particularly to an improved apparatus for humidifying a gas.

1 Claim, 5 Drawing Figures

FIG. 2
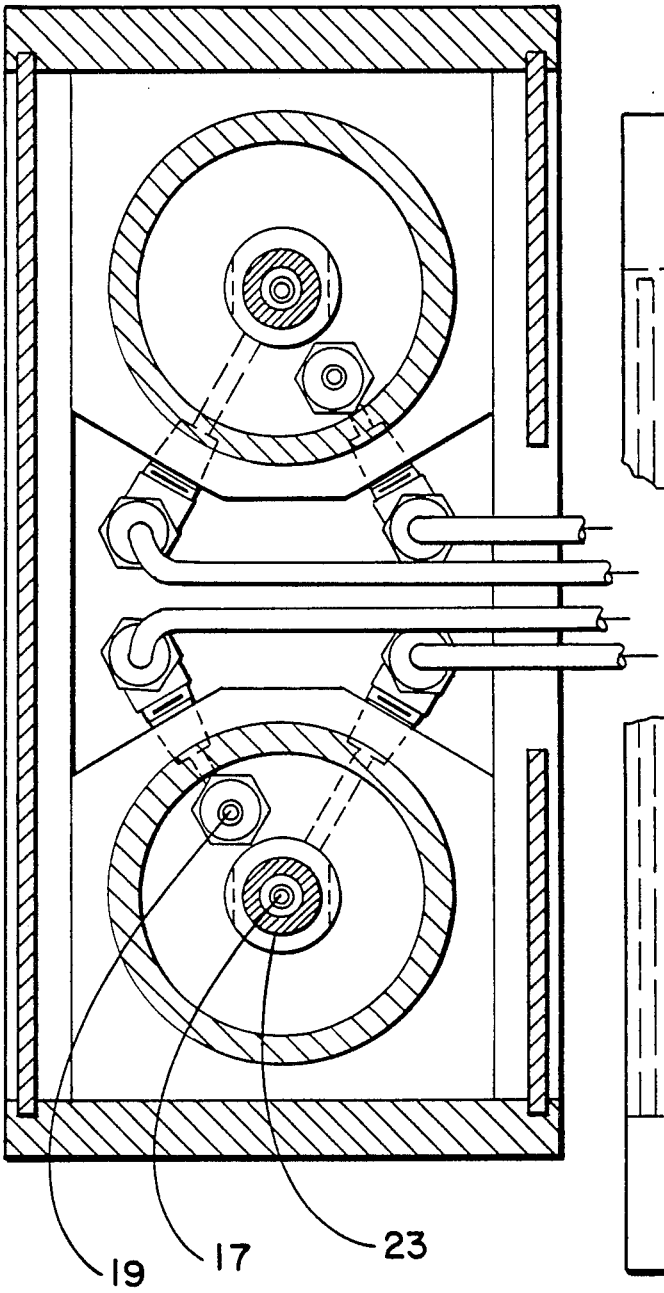
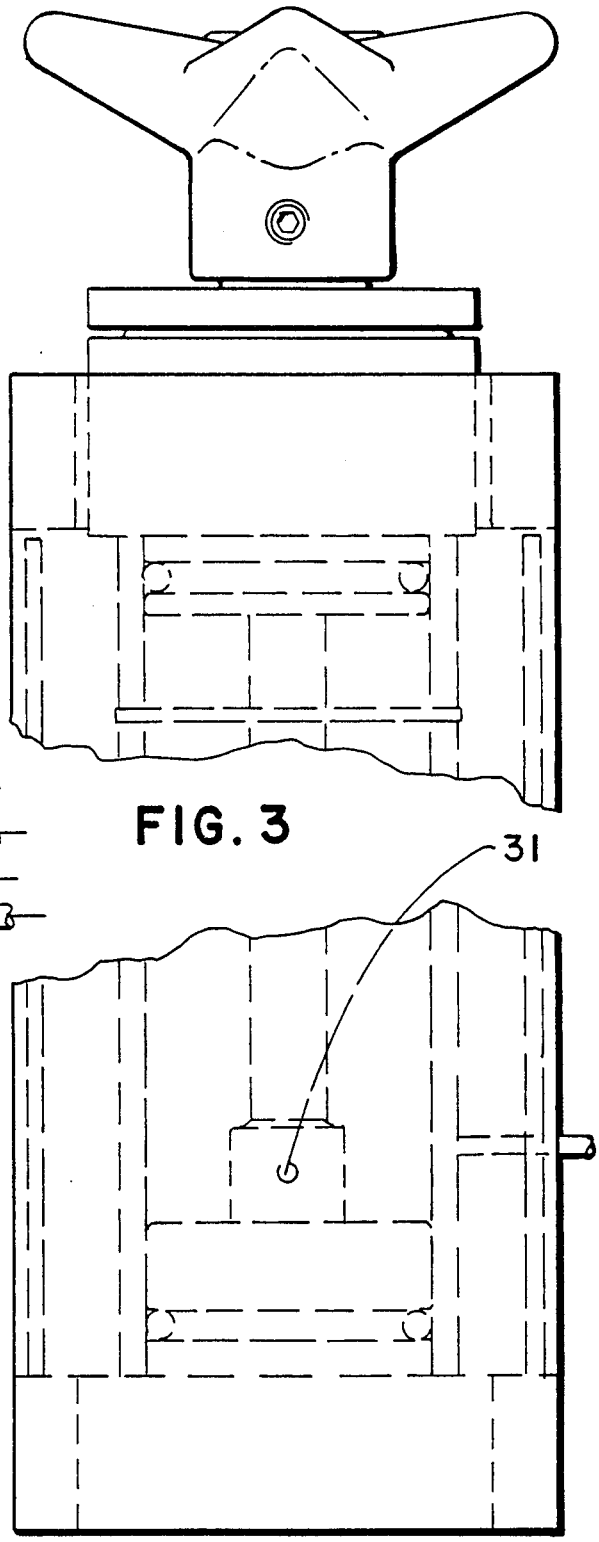
FIG. 3

GAS HUMIDIFIER SCHEMATIC LAYOUT

GAS HUMIDIFICATION APPARATUS

BACKGROUND OF THE INVENTION

This invention relates generally to the art of gas humidification and more particularly to an improved process and apparatus for humidifying a gas.

In a paper dated Mar. 25, 1982, by R. Dorschner of American Can Company there is described a process and apparatus for humidifying gases.

In essence, the process comprises bubbling gas through a vertical column of water to saturate the gas with moisture and subsequently mix the saturated gas with a dry gas to arrive at a resulting mixture having a desired relative humidity.

The apparatus and process described for conducting the gas humidification is complex and space consuming.

SUMMARY OF THE INVENTION

It is thus an object of this invention to provide a simplified and improved process and apparatus for carrying out gas humdification.

It is a further and more particular object of this invention to provide an improved column for contacting such gases with liquid.

These, as well as other objects, are accomplished by utilizing an apparatus wherein a contact column comprises a vertically oriented column with top and bottom closures and entrance and exit ports through the bottom closure. The exit port communicates with a conduit which extends from the exit port to above the liquid level within the column such that gases pass through the entrance port to the top of the column and then back through the column via conduit means to the exit port. In a particularly preferred embodiment the gas enters through an entrance port, passes through conduit means to above the top of the liquid level and thence through additional conduit means back down the column through the liquid from that point.

BRIEF DESCRIPTION OF THE DRAWINGS

FIG. 2 of the drawings is a view along the line 2—2 of FIG. 1.

FIG. 3 of the drawings is a right side view of FIG. 1.

DETAILED DESCRIPTION

In accordance with this invention it has been found that saturated gases may be better equilibrated and stabilized under conditions of saturation utilizing the column of this invention than was heretofore available. Additionally it has been found that when utilizing the column of this invention in combination with gas humidification and mixing apparatus that the resultant mixed gas has a greater stability with regard to maintained relative humidity than was heretofore possible. It has additionally been found that the use of mass flow controllers rather than conventional valves in mixing a gas results in unexpectedly beneficial results. Various other advantages and features will become apparent from the following description given with reference to the various figures of drawing.

Figure 1:
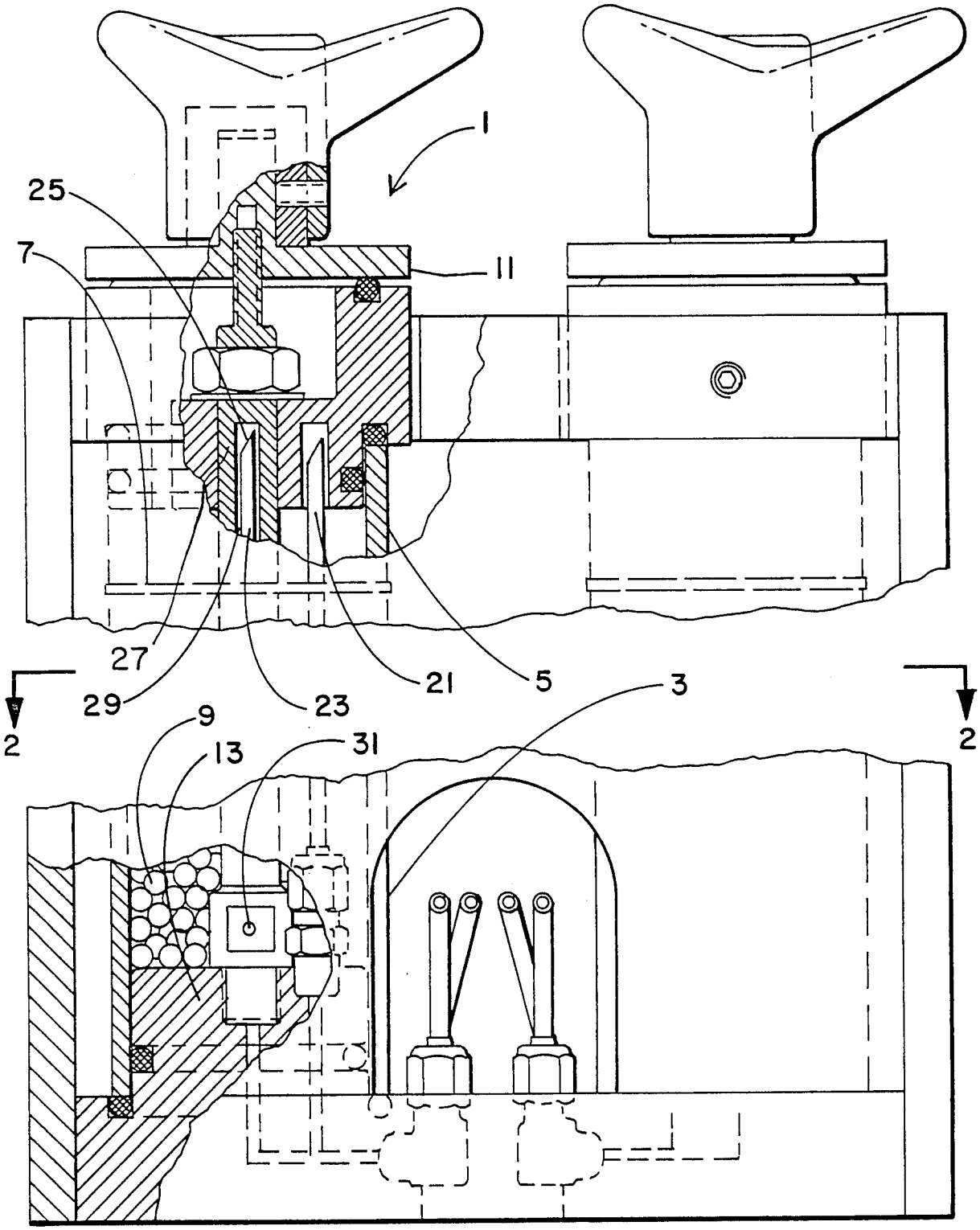
FIG. 1 of the drawings illustrates a pair of columns in accordance with this invention.

FIG. 1 of the drawings illustrates a pair of columns 1 in accordance with this invention. For purposes of description, however, the left view column 3 will be described.

Column 3 comprises a vertically oriented hollow column 5 filled with a liquid to a predetermined level 7. Preferably the column is also filled with a number of beads 9 in order to maximize the travel path for gas being bubbled through the column. The column has a top closure 11 and a bottom closure 13.

The bottom closure 13 defines, as is best illustrated in FIG. 2 of the drawings, an inlet port 17 and the exit port 19.

Gas entering through entrance port 17 is bubbled through the height of the column via variations in density between the gas and the liquid and is preferably directed through the column by means to be described below.

After traversing the height of the column the bubbled gas arrives above predetermined level 7 where it is in communication with exit conduit means 21. The gas thus travels through exit conduit means 21, the height of column 5 to exit port 19 also in communication with exit conduit 21. By this arrangement the columns may be utilized without the necessity of external gas communication lines communicating with the tops of the columns.

As an additionally preferred feature of this invention, entrance port 17 communicates with entrance conduit 23 whereby gas entering through entrance port 17 travels the height of column 5 through entrance conduit 23 whereupon it exits at opening 25 to be entrapped by shroud 27. The gas then passes through the passageway 29 defined by the clearance between entrance conduit 23 and shroud 27 to arrive at opening 31, FIG. 3, whereby the gas thus enters the column for bubbling through the height thereof.

It should be noted that opening 25 is above predetermined level 7 in order to prevent syphoning of liquid through entrance port 17.

It is thus seen that in the preferred embodiment of the column of this invention a gas to be bubbled through the liquid makes three (3) complete passes through the height of the column before contact and one final pass through the height of the column upon removal therefrom. It is felt that the temperature equilibration that occurs both before and after contact is responsible for the superior stability characteristics of humidified gas in accordance with this invention.

Figure 4:
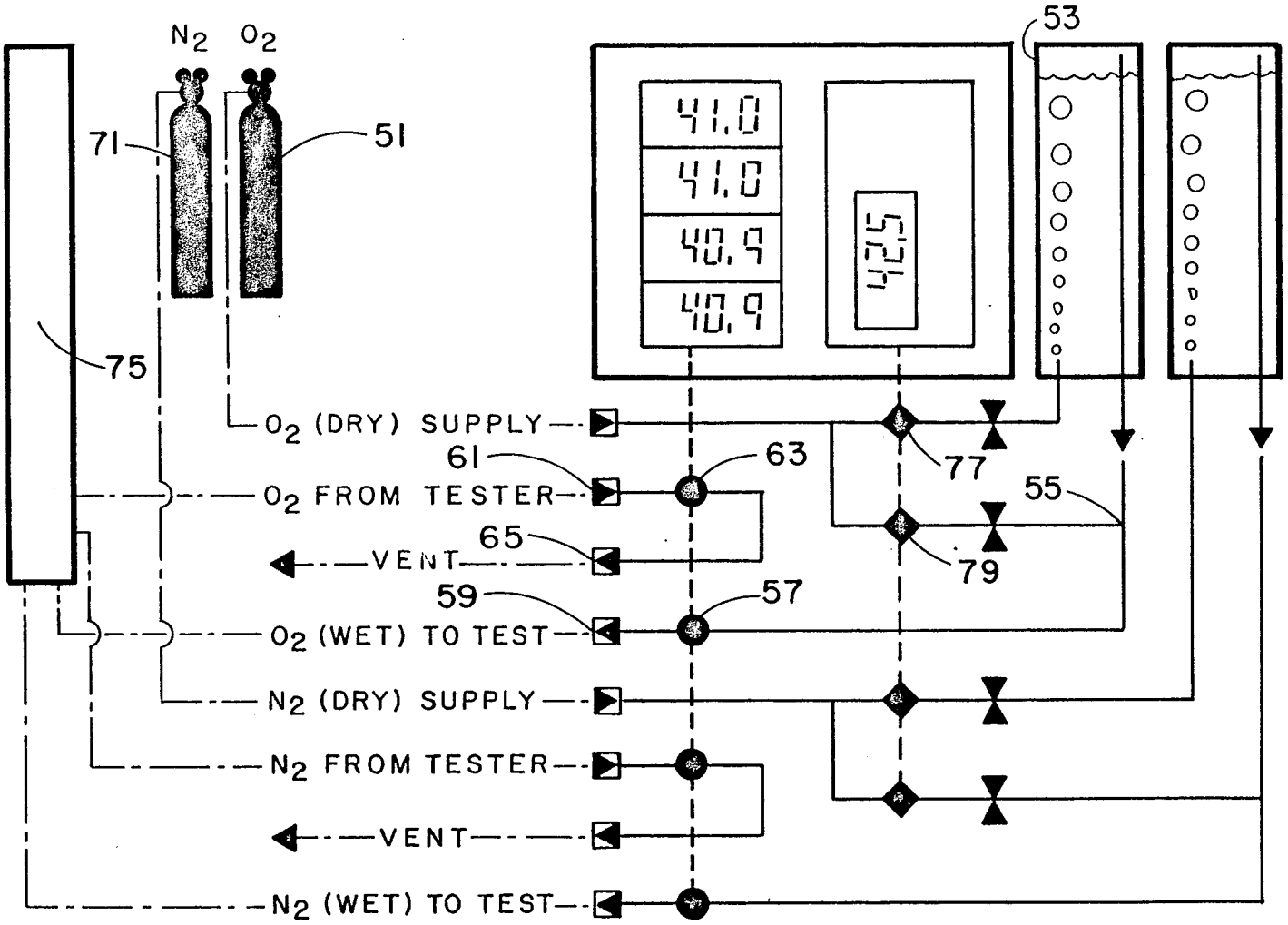
FIG. 4 of the drawings shematically illustrates a complete gas humidification apparatus in accordance with this invention.

FIG. 4 of the drawings illustrates the utilization of columns in accordance with this invention for humidifying two gases to desired relative humidities. It is thus seen that a source of gas such as oxygen 51 passes into a column 53 in accordance with this invention and is removed therefrom where it is mixed at 55 with dry oxygen in a desired ratio for passing through a humidity tester 57. The gas then moves out port 59 to a testing apparatus 75.

It is preferred that once the gas has been passed through testing apparatus 75 that it be returned through port 61 for again testing, at 63, the relative humidity thereof prior to venting at 65. By testing the relative humidity both before and after testing the exact humidity within the testing apparatus may be better stated. It has been found, however, that the apparatus of this invention provides a more stable relative humidity than apparatus which have heretofore been utilized.

As further illustrated in FIG. 4 a second gas such as nitrogen is provided by source 71 and in essence travels through a similar system as that described above with respect to oxygen.

As a significant additional aspect of this invention, it has been found that utilization of mass flow control valves with a controlling electronic chassis for use in mixing wet and dry gasses at 77 and 79 as well as the counterpart thereof as illustrated in the nitrogen circuit provides significant control to the overall apparatus. Such mass controllers compensate for pressure variations at either end of the system to maintain the desired flow rate. Such a mass flow control valve in accordance with this invention is sold by the Tylan Corporation of Carson, Calif., under Model FT260, as described in U.S. Pat. Nos. 3,650,505; 3,851,526; 3,938,384 and Re. 31,570 which are herewith incorporated by reference.

A preferred form of testing apparatus 75 for utilization with the gas humidification unit of this invention is the apparatus described in my issued U.S. Pat. No. 4,464,927 for a gas transmission analyzer.

Figure 5:
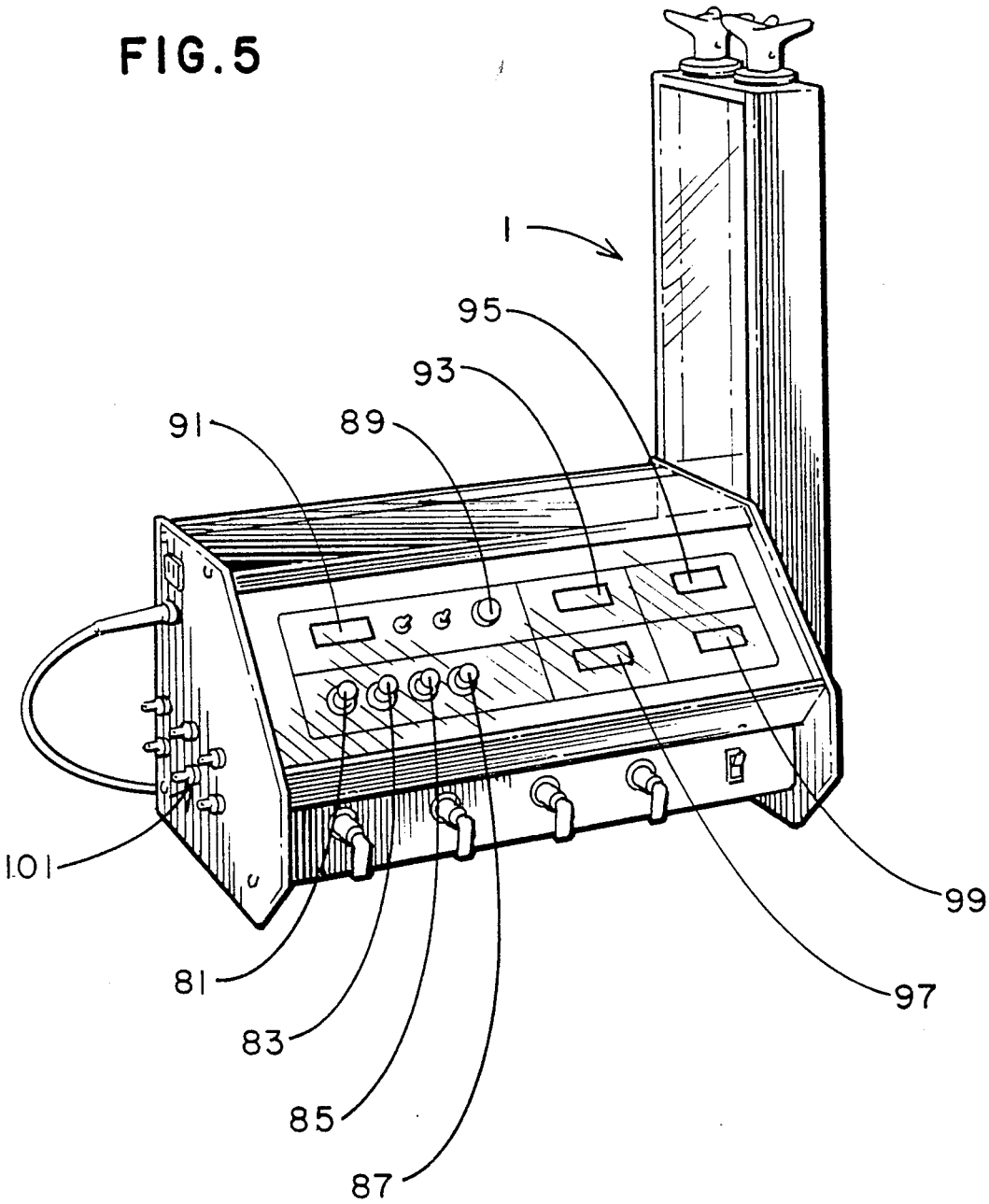
FIG. 5 of the drawings illustrates the housing and controls for the apparatus illustrated in FIG. 4 of the drawings.

FIG. 5 of the drawings illustrates the compact structure permitted when utilizing a column structure such as that previously described. It should be noted that the apparatus merely displays the entrance and exit ports described with regard to FIG. 4 without a multiplicity of tubes and pipes visible on the exterior of the apparatus. As illustrated in FIG. 5, the apparatus comprises a pair of columns 1 as described above in communication with a console having four digital controls to control the flow through mass control valves such as 77 and 79 described above. Thus, 81 and 83 control the flow of a first gas such as oxygen with one of the mass controllers controlling the flow of wet gas and the other the flow of dry gas. As a similar feature, dials 85 and 87 control the flow of the second gas. Dial 89 is a selector valve for illustrating a flow rate with regard to the flows controled by dials 81, 83, 85 and 87 upon digital readout screen 91. Screen 93 is a continuous monitor of the relative humidity of the first gas such as oxygen routed to the testing apparatus 75 while 95 is an indication of the relative humidity of the gas returning from the testing apparatus. In a similar fashion screens 97 and 99 show similar relative humidities for the second gas such as nitrogen. Generally indicated at 101 are a plurality of entrance and exit ports for commnication with testing apparatus 75.

It is thus seen that the apparatus and process of this invention provide a new and improved gas humidification system as well as an improved humidification column and process. As many variations will become apparent to those of skill in the art from a reading of the above description, such variations are embodied within the spirit and scope of this invention as defined by the following appended claims.

What is claimed is:

1. An apparatus for humidifying first and second gases for supplying such gases to means for measuring the transmission of one gas into the other gas comprising:

a pair of generally vertically oriented hollow cylindrical columns, each column comprising:

a top closure on each said column;

a bottom closure on each said column whereby each said column, said top closure, and said bottom closure define a volume within each said column which may be filled to a predetermined level with a liquid;

water and beads within said volume up to said predetermined level;

said bottom closure defining an entrance port and an exit port;

an entrance conduit communicating with said entrance port and extending vertically above said predetermined level;

a shroud covering said entrance conduit and defining an opening into said column below said predetermined level;

an exit conduit communicating with said exit port and passing through said column within the hollow thereof to a point vertically above said predetermined level;

whereby gases to be humidified enter each said column through said entrance port, travel upwardly through said entrance conduit, contact said shroud and move downwardly through said shroud and through said opening in said shroud, bubbles upwardly through said water and said beads within said column above said predetermined level, then enters said exit conduit and proceeds downwardly through said column and said exit conduit and out through said exit port;

a first source of gas communicating with an entrance port of one of said columns comprising;

a pressurized tank of said first gas communicating with means for dividing a flow of said first gas into two parts, conduit means communicating a first part of said first gas to a first mass flow controller, conduit means communicating between said first mass flow controller and said entrance port of said first column, conduit means receiving the second part of said first gas in communication with a second mass flow controller, means joining said second mass flow controller and said exit port of said first column to combine said humidified first gas and said first gas whereby the combined first gas has a controlled humidity by varying the flow through said first and second mass flow controllers, a source of a second gas communicating with said entrance port of the other column comprising;

a pressurized tank of said second gas communicating with means for dividing a flow of said second gas into two parts, conduit means communicating a first part of said second gas to a third mass flow controller, conduit means communicating between said third mass flow controller and said entrance port of said second column, conduit means receiving a first part of said second gas in commnication with a fourth mass flow controller, means joining said fourth mass flow controller and said exit port of said second column to combine said humidified second gas and said second gas whereby the combined second gas has a controlled humidity by varying the flow through said third and fourth mass flow controllers.

* * * * *